US006630056B1

(12) United States Patent
Thibierge et al.

(10) Patent No.: US 6,630,056 B1
(45) Date of Patent: Oct. 7, 2003

(54) COLOR TRACING PAPER

(75) Inventors: Emeric Thibierge, Colombes (FR); Jean-Francois Loeillot, Colombes (FR); James Christopher Body, Ashford (GB); Robert Graham Bracewell, Canterbury (GB)

(73) Assignees: Thibierge & Comar, Paris (FR); Arjo Wigging Fine Papers Limited, Basingstoke (GB)

( * ) Notice: Subject to any disclaimer, the term of this patent is extended or adjusted under 35 U.S.C. 154(b) by 0 days.

(21) Appl. No.: 09/254,447

(22) PCT Filed: May 7, 1998

(86) PCT No.: PCT/FR98/00930

§ 371 (c)(1),
(2), (4) Date: Dec. 13, 1999

(87) PCT Pub. No.: WO99/02774

PCT Pub. Date: Jan. 21, 1999

(30) Foreign Application Priority Data

Jul. 10, 1997 (FR) ..... 97 08990

(51) Int. Cl.[7] ..... D21H 11/00

(52) U.S. Cl. ..... 162/162; 162/187; 8/400; 8/919; 8/637.1

(58) Field of Search ..... 162/162, 187; 8/400, 919, 637.1

(56) References Cited

U.S. PATENT DOCUMENTS 2,128,739 A 8/1938 Connor ..... 154/46
5,131,910 A 7/1992 Breault ..... 8/400
5,543,382 A 8/1996 Watanabe et al. ..... 503/224

FOREIGN PATENT DOCUMENTS

| | | |
|---|---|---|
| DE | 250553 | 7/1911 |
| DE | 603554 | 3/1936 |
| EP | 0 097 371 | 1/1984 |

OTHER PUBLICATIONS

"Paper vocabulary," Swedish Standards Institution, SIS handbook 146, first Ed,. 1980 (Stockholm): sous #506 "glassine."

Database Paperchem; The Institute of Paper Science and Technology, Atlanta, GA, US; Tamagawa, M. et al: Dyeing of Paper with Vat Dyes XP002058594 & JP 49 125 614 A (Honshu Paper Mfg. Co. Ltd) Dec. 2, 1974.

*Primary Examiner*—Peter Chin
*Assistant Examiner*—Mark Halpern
(74) *Attorney, Agent, or Firm*—Armstrong, Westerman & Hattori, LLP

(57) ABSTRACT

An intensely colored transparent and/or translucent paper has chroma c and brightness L, as measured by a Hunterlab instrument, which measures the Cartesian coordinates a, b, L of a point P of color and its polar coordinates H and c. The paper is such that the ratio of c to L is higher than 30%, preferably higher than 50%. The paper contains a colorant in the stock, preferably 5 to 10% by weight of liquid coloring agent in relation to the weight of the finished paper. The colorant is a coloring agent which fixes directly in the cellulose. The paper is suitable for printing and/or writing.

21 Claims, 2 Drawing Sheets

COLOR TRACING PAPER

This invention relates to an intensely colored transparent and/or translucent paper, more specifically an intensely colored tracing paper or an intensely colored transparentized paper.

It is already known that tracing papers are made from highly beaten cellulose fibers. Such papers are transparent and are used in technical drawing or by architects. Such papers are greyish in color.

It is also known that transparent papers are obtained by transparentizing opaque papers by means of chemical compositions based on a non-volatile liquid or wax. These papers are commonly called transparentized papers.

It is also known that transparent or translucent papers, colored or not, are obtained from initially opaque paper by means of high pressure hot calendering.

This kind of paper, called "glassine" is easily recognizable by the extreme smoothness of its surface. This smoothness is the direct result of the heavy pressure to which it is subjected in the calender to make it transparent. The Bekk smoothness value usually exceeds 2,000 seconds for paper of this type.

The technique used to make the basic paper does not include beating the fibers to a high degree before the sheets are formed. When such a paper is colored, the coloring agents are not easily fixed on the fibers and it is difficult to obtain paper with an intense color.

It is also known that transparent or translucent papers, colored or not, are obtained from an initially opaque paper by the sulfurisation process.

This kind of paper, called "parchment" or "vegetal parchment" is made transparent by chemical treatment. The opaque basic paper is immersed in a bath of sulfuric acid which dissolves part of the cellulose of the fibers. This bath is followed by repeated rinsing in water during which the cellulose recrystallizes while the acid in excess is eliminated. This does not facilitate fixation of coloring agents and it is therefore difficult to obtain intensely colored papers.

It is also known that tracing papers exist which are slightly bluish in color and are used by architects along with "diazo" paper to reproduce plans. Likewise, it is known that tracing papers exist which are slightly pinkish and are used for technical drawing.

DE-C-603 554 describes a process for making printing paper, board for printing or other board by assembling damp sheets of unfinished paper containing dyes or fillers with layers of ordinary paper. This process is such that fillers or dyes are added in quantities equivalent to once or twice the dry weight of the fibers and the layers of paper are thus stratified. This document therefore concerns the manufacture of paper or board which comprise several layers of fibers. In no way does this document concern the manufacture of a colored tracing paper.

EP-A-0 097 371 relates to a process for making paper or other similar products by putting fibrous matter in suspension in a pulper, grinding the pulp to shorten, fibrillate and hydrate the fibers, sometimes mixing the stock of fibers obtained with additives, coloring agents and/or binders, and draining it on a wire, a process wherein 10% to 35% of the weight of cellulose is replaced by reinforcing agents. These reinforcing agents may be reinforcing agents derived from maize, rice and wheat. Consequently, this document certainly does not relate to the manufacture of tracing paper. It describes only the manufacture of a paper, which may be colored in the stock, and with additives derived from corn, rice, etc.

US-A-2 128 739 relates to a laminated paper made from two sheets of paper between which a wax film is laid. A laminated sheet is obtained which is greaseproof and waterproof. A colored or dyed product may be added to the stock.

This document describes the coloring of a paper during the papermaking process by adding a coloring agent. It is clearly stated that the gloss and opacity of the paper are maintained. The coloration of the paper is controlled by measuring the value of brightness L, the value a which is the color difference between red and green and the value b, which is the color difference between yellow and blue. This document in no way describes the manufacture of a colored tracing paper. It describes only the way the coloring of a paper can be adjusted by measuring L, a and b.

DE-C-250 533 relates to a process for coloring paper in the stock. The coloring solution is piped into the headbox.

JP-A-49 125 614 describes the reduction of the wood stock by means of a hydrosulfite and soda reducing agent. The pulp is mixed with a water-soluble coloring agent. It is therefore not a process for making tracing paper.

This invention aims to provide a translucent and/or transparent paper comprising highly refined fibers beaten to a very high Schöpper degree, of 50 to 80 or at least higher than 80, or a paper transparentized by means of a chemical compound, which has an intense color and Bekk smoothness below 2,000 seconds, preferably below 30 seconds, the cellulose of which is 100% in the form of fibers and which can be used for printing and/or writing.

This invention also aims to provide a tracing paper containing a high percentage of coloring agent.

This invention also aims to provide a highly colored tracing paper with an even look through.

The invention also aims to provide a process for making highly colored tracing paper or a highly colored transparentized paper.

Men skilled in the art of papermaking know that there are several methods for coloring a non-transparent paper.

The first method is to print the paper on both sides. The inventors carried out many printing trials on the front and back of translucent and/or transparent paper sheets, especially tracing paper obtained from highly refined fibers. However, when both sides of a sheet of tracing paper are printed, whether by flexography, photogravure or offset, transparency is greatly altered and printability deteriorates.

A second method for coloring paper is to coat the front or back of the sheet, this coating being done with a composition containing coloring agents, fillers and a binder. The inventors therefore coated a translucent and/or transparent paper with a colored composition. However, the higher the percentage of coloring agent, the greater the loss of transparency.

A third method for coloring paper is to introduce a coloring agent in the aqueous solution of cellulose fibers. This technique can be used only if the coloring agent is introduced before the circuit in which the paper pulp is mixed with water and the other traditional ingredients in the paper. The coloring agent must stay in contact with the cellulose fibers long enough for the coloring agent to be fixed in the fibers. Men skilled in the art of papermaking know that if the amount of coloring agent is increased, only part of the coloring agent fixes in the fibers, because once the fixation sites on the fibers are occupied by the coloring agent, no further coloring agent can be fixed. Therefore men skilled in the art of papermaking think that it is impossible to fix more than about 5% by weight of liquid coloring agent in relation to the finished paper. Moreover, the more colorant we introduce, the more is discharged in the underwire waters, which leads to pollution of the machine circuits and the environment.

A fourth method is to color the tracing paper after the drying cylinders, in the size press. However such a process does not give the paper an intense tint.

Consequently, the inventors had to find ways to:

- obtain a transparent and/or translucent colored paper which has a pronounced or intense tint;
- obtain a transparent and/or translucent colored paper which stays transparent even though it has an intense color;
- obtain a transparent and/or translucent colored paper which has a good look through, i.e. an even look through;
- obtain a transparent and/or translucent colored paper which has a Bekk smoothness below 2,000 seconds and preferably below 30 seconds;
- obtain a transparent and/or translucent colored paper in which the cellulose fibers are 100% in the form of fibers or fibrils;
- obtain a transparent and/or translucent colored paper which has printability as good as that of uncolored tracing paper;
- obtain a transparent and/or translucent colored paper by a manufacturing process which causes little pollution in the machine circuits;
- obtain a transparent and/or translucent colored paper by a manufacturing process which only slightly colors the underwire waters discharged by the papermaking machine.

Technically, all these problems seemed insoluble by men skilled in the art of papermaking, since increasing the color of the paper should have sharply reduced the transparency of the paper and increased pollution. Moreover, professional papermakers thought that increasing the amount of colorant above about 5% would not intensify the hue of the paper since the surplus colorant could not be fixed in the cellulose fibers.

But, the inventors, in opposition to the preconceived ideas of men skilled in the art of papermaking and after many tests, managed to obtain a transparent and/or translucent paper, that is, a paper comprising highly refined fibers (tracing paper) or a paper transparentized by a chemical compound, with an even look through and an intense hue. To this purpose, the inventors made a transparent and/or translucent paper comprising highly refined fibers with a Schöpper degree of 50 to 80 or at least higher than 80 or obtained by transparentization, with a Bekk smoothness below 2,000 seconds, preferably below 30 seconds, wherein the cellulose is 100% in the form of fibers and/or fibrils, and introducing a coloring agent in the stock. This paper has a defined intense or dark color such that the color intensity c (or chroma) and the brightness L measured on an instrument such as a Hunterlab or Datacolor instrument are as follows:

- either the ratio of c to L is higher than 50%, preferably higher than 60% and even more preferably higher than 70%,
- or L is lower than or equal to 60, preferably lower than or equal to 50,
- or the ratio of c to L is higher than 50%, preferably higher than 60% and even more preferably higher than 70% and L is lower than or equal to 60, preferably lower than or equal to 50.

The inventors obtained such a paper, in an unexpected way, by refining the paper pulp to a Schöpper degree of 50 to 80 or at least above 80, and introducing the coloring agent just before the headbox, that is well after the pulper, in opposition to what has always been done in the traditional manner to obtain an intense color. The paper comprises from 5% to 10% in weight of liquid dye rapported to the weight of finished paper.

Without wishing to be bound by theory, the inventors think that because the fibers are highly refined, that is that they comprise many fibrils, the number of fixation sites for the coloring agent is increased and that, compared with the same weight of paper obtained with lightly beaten fibers, the quantity of colorant fixed can be increased up to four times.

Moreover, because the fibers are highly refined, the coloring agent can be introduced in the headbox because the contact time between the fibers and the coloring agent does not have to be very long since the fibers have many sites for fixing the coloring agent owing to the presence of numerous fibrils.

Moreover, when making transparent and/or translucent paper, the temperature of the fibrous suspension is maintained between about 80° and 100° C. to permit better drainage of the paper sheet. But these relatively high temperatures are highly conducive to the fixation of colorants in the fibers.

When making a paper transparentized by a chemical compound, the chemical phenomena differ from those mentioned above, and lead in an unexpected way to an intensely colored transparentized paper.

The inventors prepared an intensely colored transparentized paper in an unexpected way by making an aqueous suspension of fibers and a water-soluble coloring agent, by depositing this suspension on the wire of a papermaking machine, by removing the water by gravity, then by drying the sheet between two roller dryers, and by depositing on the sheet thus dried a transparentizing chemical compound and finally drying the sheet.

Thus, the introduction of the coloring agent in the headbox avoids polluting the part of the machine between the pulper and the headbox. As the coloring agent is held by the fibrils, the underwire water contains very little coloring agent and therefore pollution is reduced.

Besides, as the finished paper is transparent and/or translucent, each particle of coloring agent plays a visible role. The colorant in the mass of the paper is visible. On the contrary, for non transparent papers, only the colorant on the surface of the paper is visible and therefore, to obtain an intense hue, much more colorant must be introduced.

The invention also concerns a transparent and/or translucent paper containing a colorant in the stock, introduced in the headbox, on which a colorant in an aqueous medium has been deposited in the size press, to increase the intensity of the hue when the same colorant is used and to obtain textured effects when a different colorant is used.

The invention also concerns a transparent and/or translucent paper containing a fluorescent coloring agent, added to the stock or in the size press, and perhaps one or several other water-soluble coloring agents.

The following description, along with the figures and examples given in the appendix in a non exhaustive manner, will explain how the invention can be put into practice.

As the Figures show, the colors are characterized by a system of polar coordinates L, c, H. A system of orthogonal coordinates L, a, b, can also be used.

The first parameter L is the brightness of the color. Values vary from 0 to 100 and indicate whether the color is dark (0) or light (100).

The second parameter c is the chroma (or purity) of the color. It also varies from 0 to 100. When c is low, the color varies from pure black (L=0) to pure white (L=100) going through the range of greys.

As c increases, the color becomes more intense, whatever the hue may be. c=100 corresponds to the purest and most intense colors.

H is the hue, that is, the color itself. This parameter varies from 0 to 360°. It indicates the position of the hue in degrees of the chromatic circle: 0=red, 90=yellow, 250=blue, 300=violet.

To define the colors of tracing paper or transparentized papers according to this invention, the brightness L is recorded on the x-axis and the chroma c on the y-axis.

According to this invention, papers containing highly refined fibers (or tracing papers) or colored transparentized papers are such that the chroma c and the brightness L are defined in the following manner:

- either the ratio of c to L is higher than 50%, preferably higher than 60% and even more preferably higher than 70%,
- or L is lower than or equal to 60, preferably lower than or equal to 50,
- or the ratio of c to L is higher than 50%, preferably higher than 60% and even more preferably higher than 70% and L is lower than or equal to 60, preferably lower than or equal to 50.

Figure 1:
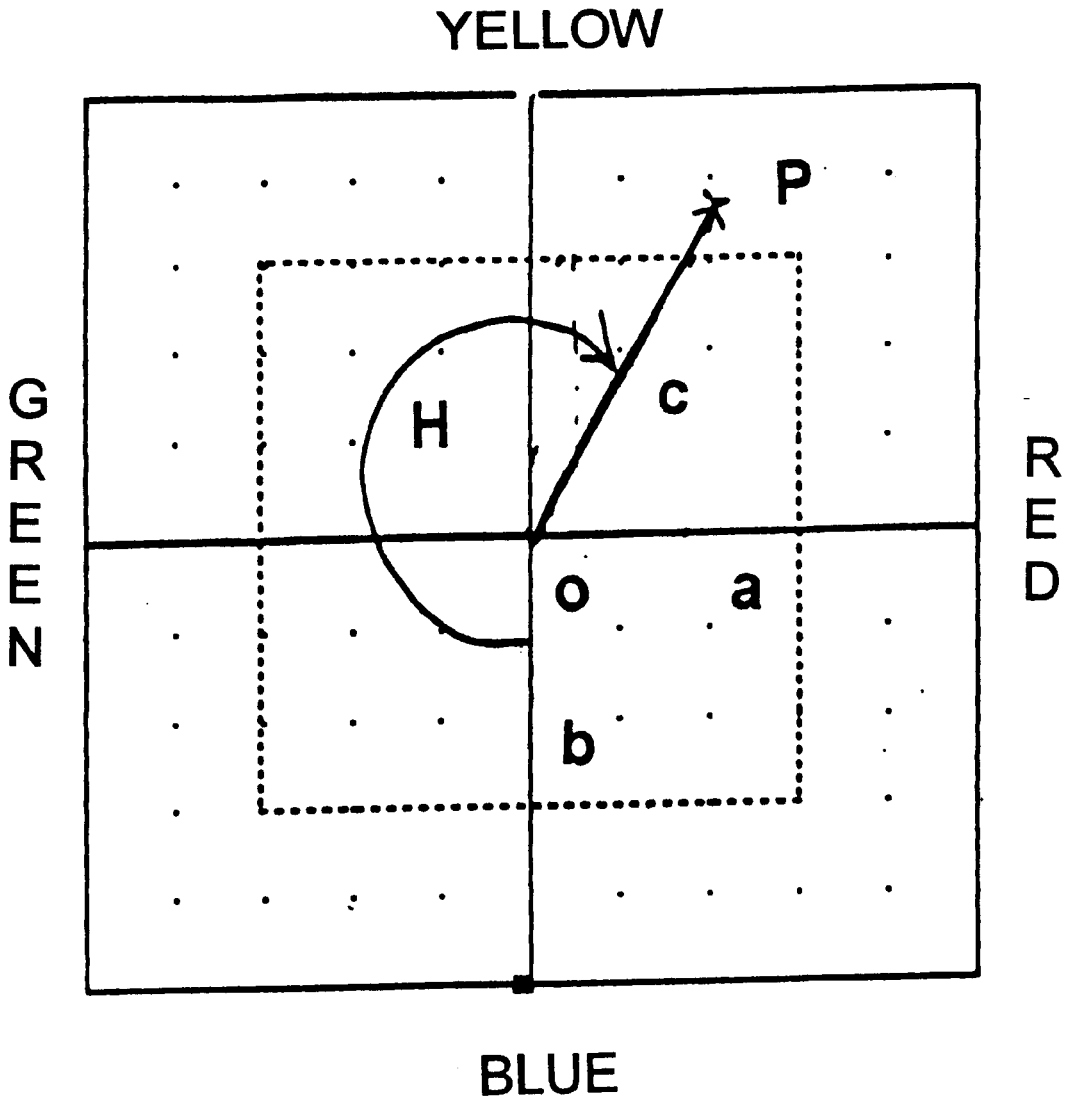
FIG. 1 is a diagram showing the coordinates obtained with a color measurement instrument for the papers according to the invention.
Figure 2:
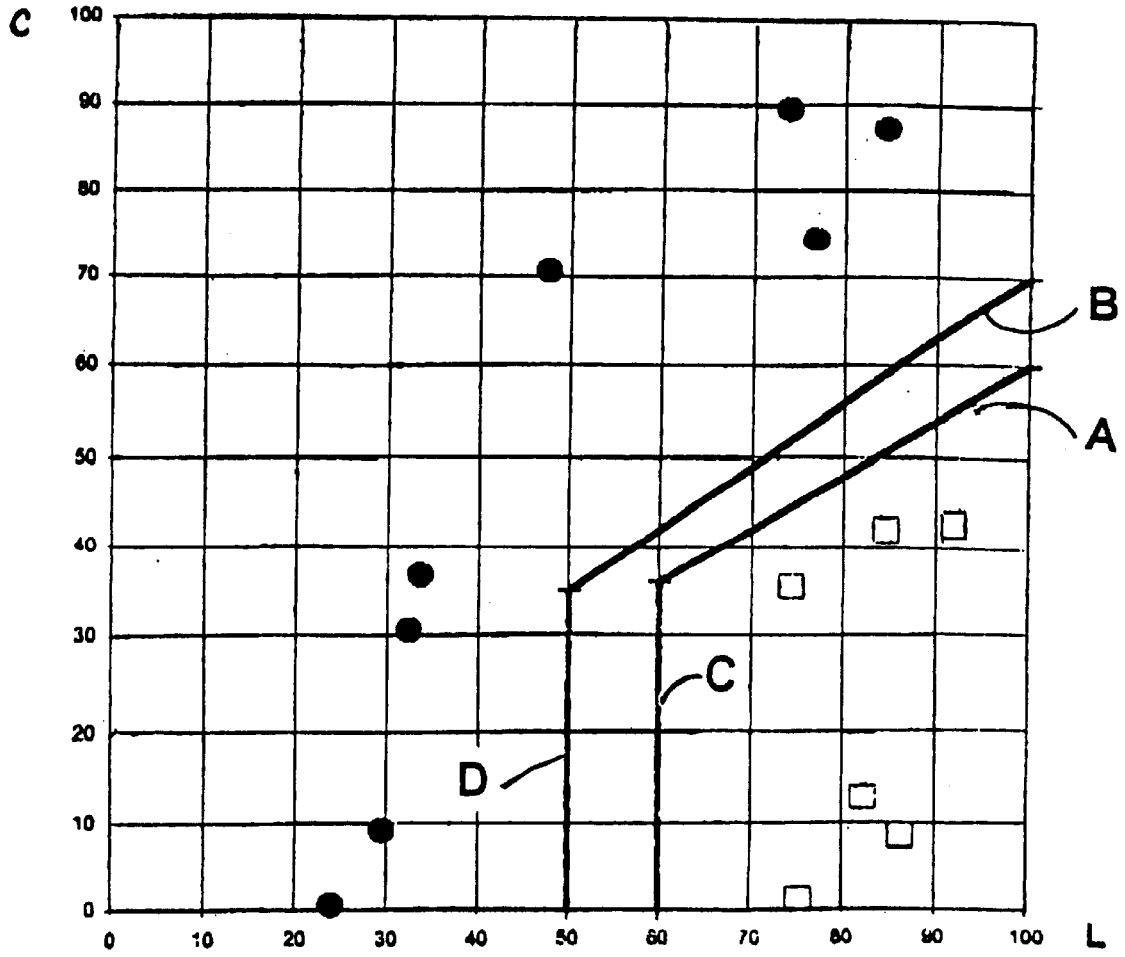
FIG. 2 is a diagram showing the L values on the x-axis and the c values on the y-axis for papers according to the invention and papers using the earlier technique.

White papers and papers with pale, not very intense colors are found at the bottom left of FIG. 2 and are represented by squares. They are not part of this invention. Tracing papers or transparentized papers with bright, highly saturated colors which are the subject of this invention are found in the upper right of the graph in FIG. 2; tracing papers or transparentized papers with dark colours according to this invention are found on the left of the graph. The papers according to this invention are represented by points on the graph in FIG. 2.

COMPARATIVE EXAMPLE 1

Long fibers of paper pulp obtained from softwood are put in suspension in water in a pulper, then they are beaten in a beater until a Schöpper of 60 is obtained. The temperature of the aqueous suspension of fibers is maintained between 80–100° C. Then the aqueous suspension of fibers is deposited on the wire of a Foudrinier paper machine, and the water is removed by gravity. The relatively high temperature of the aqueous suspension is needed to remove the water by gravity, as the fibers have a strong affinity for water because of the large number of fibrils present. Then the sheet is pressed to remove residual water. The sheet is then dried between two roller dryers. A transparent paper is thus obtained. This paper is a conventional tracing paper, greyish in color.

An ink is prepared composed of a binder, a solvent and 15% by weight of blue dye. The tracing paper obtained by the above process is printed by flexography on both sides. A blue paper is obtained. The paper has lost its transparency. It may have some defects due to the printing. The coloring is not even. Printing ink on the paper alters the condition of the surface, and therefore its printability. Tracing paper printed with oily ink containing the coloring agent is more difficult to print on.

COMPARATIVE EXAMPLE 2

A tracing paper is prepared as in comparative example 1. Next an aqueous composition is prepared containing the coloring agent, fillers and latex. The sheet is then coated on both sides with this composition. Machinability problems occur. In addition, coloring a tracing paper by coating makes it lose its transparency. Moreover, coating a tracing paper seems to cause the paper to curl badly.

EXAMPLE 1

Long fibers of paper pulp obtained from softwood are put in suspension in water in a pulper, then they are beaten in a beater until a Schöpper of 60 is obtained. The temperature of the aqueous suspension of fibers is maintained between 80–100° C. Then the aqueous suspension of fibers is deposited on the wire of a Foudrinier paper machine, and the water is removed by gravity. Then just before the headbox of a paper making machine, a blue coloring agent in an aqueous solution is added to the aqueous suspension of fibers, the quantity of dye being such that it is 6% by weight in relation to the dry weight of the finished paper. The dye is a direct coloring agent which fixes directly in the cellulose, brand CARTASOL®, reference blue 3RF, made and sold by Clariant (Switzerland). The suspension of fibers and colorant is deposited on the wire of a Fourdrinier paper machine and the water is removed by gravity. The water which is discharged by the machine is only very slightly colored, which shows that the dye has fixed well in the fibers. Then the sheet is dried between roller dryers. A transparent and/or translucent paper is obtained which has a dark blue color. The weight of the colorant in relation to the finished paper is higher than 5%.

The shade of the paper is measured by means, for example, of an instrument made by Hunterlab. Such an instrument enables us to measure the Cartesian coordinates in three directions a, b, L of a point P of a color. Thus the point P is located in relation to the four colors blue, red, yellow and green. If a is positive, the color is closer to red, if a is negative the color is closer to green. If b is positive, the color is closer to yellow, if b is negative the color is closer to blue. On the figure, the point P represents a color which is quite red and slightly yellow, it is therefore orange. The third coordinate, perpendicular to the a and b plane, represents the brightness of the color. The Hunterlab instrument also enables us to measure the polar coordinates of point P. The distance between the centre O and point P is c and is called chroma. It represents the intensity of the color. The angle H enables us to locate point P in relation to the four colors yellow, red, blue, green.

The values obtained with the Hunterlab instrument are given in Table 1 below.

EXAMPLE 2

A transparent paper is prepared in the same manner as in example 1, but a red colorant is added to the headbox, a dye made by Clariant, the same brand as in example 1 with the reference number 2 RF. The amount of dye is 10% by weight in relation to the weight of the finished paper. A dark red transparent paper is obtained. The shade of the paper is measured as in example 1. The values are given in Table 1 below.

EXAMPLES 3 TO 5

Papers are made in the same way as in example 1, using yellow dyes 5GFN and RF by Clariant, the same brand as those used in the previous examples. They are mixed with 2RF red dye to obtain yellow, or orange or carmine. The color of the papers obtained is measured in the same way as in the previous examples. The results are given in Table 1 below.

| Eg n° | Color | L | A | b | c | H | c/L |
|---|---|---|---|---|---|---|---|
| 1 | blue | 27.27 | 4.81 | −16.45 | 17.14 | 286.31 | 62.85% |
| 2 | red | 47.56 | 59.59 | 38.01 | 70.68 | 32.53 | 148.61% |
| 3 | yellow | 84.34 | 6.70 | 87.21 | 87.47 | 85.61 | 103.71% |
| 4 | orange | 73.81 | 34.14 | 83.01 | 89.76 | 67.65 | 91.65% |
| 5 | carmine | 32.37 | 28.16 | 12.08 | 30.64 | 23.23 | 94.66% |

The table shows that the ratio of color intensity (chroma) to brightness is well above 50% and even over 70%.

EXAMPLES 6 TO 16

Papers are made in the same way as in example 1, using other colorants mentioned in Table II below.

TABLE II

| | | L, a, b, Coordinates | | | | | |
|---|---|---|---|---|---|---|---|
| N° | Shade | L | A | b | c | h | % c/L |
| 7 | Azure | 62.51 | −6.47 | −31.01 | 31.68 | 258.21 | 50.68 |
| 8 | Turquoise | 76.46 | −38.12 | −5.46 | 38.51 | 188.15 | 50.36 |
| 9 | Absinthe | 76.77 | −10.96 | 73.83 | 74.63 | 98.44 | 97.21 |
| 10 | Yellow | 84.34 | 6.70 | 87.21 | 87.47 | 85.61 | 103.71 |
| 11 | Orange | 73.81 | 34.14 | 83.01 | 89.76 | 67.64 | 121.60 |
| 12 | Vermilion | 47.56 | 59.59 | 38.01 | 70.68 | 32.53 | 148.61 |
| 13 | Indigo | 33.61 | 10.07 | −35.38 | 36.79 | 285.89 | 109.45 |
| 14 | Carmine | 32.37 | 28.16 | 12.08 | 30.64 | 23.22 | 94.66 |
| 15 | Forest | 29.52 | −6.09 | 7.08 | 9.34 | 130.70 | 31.64 |
| 16 | Black | 23.91 | 0.63 | −0.03 | 0.63 | 357.27 | 2.64 |

COMPARATIVE EXAMPLE 3

Conventional tracing paper is prepared as in comparative example 1. Then a blue dye from Clariant, reference 3RF, in an aqueous solution, is put in the size press. The paper obtained has a bluish color. When measured with a Hunterlab instrument, it gives a c/L ratio of 10%.

EXAMPLE 17

Paper is prepared as in example 2 by feeding the colorant into the headbox. Then a red dye in an aqueous solution is deposited in the size press. A red colored paper is obtained with a c/L ratio of 90%, a more intense hue than in example 2.

Consequently, according to the invention, transparent and/or translucent papers can be obtained wherein the color intensity c is very high compared with, papers made with the earlier technique. Moreover, these papers are obtained by a new process which avoids polluting the circuits of the paper machine, since the water it discharges is only very slightly colored.

In FIG. 2 the first line A represents the values c/L=60%.

the second line B represents the values c/L=70%.

the third line C represents the values L=60(c=0 to infinity).

the fourth line D represents the values L=50

We see that the papers according the invention are positioned in the upper left section from line A and line C, and preferably from line B and line D.

Papers such that L>60 and c/L<50% simultaneously are positioned in the lower right hand part of the diagram and are papers made by the earlier technique.

What is claimed is:

1. Paper which is transparent or translucent or both transparent and translucent, in that it contains fibers with a high beating value or it is made of transparentized opaque paper by a chemical composition with Bekk smoothness below 2,000 seconds, in which 100% of the cellulose is in the form of fibers or fibrils or both fibers and fibrils, and which has an intense or dark color defined by chroma c and brightness L in the following manner:

(i) the ratio of c to L is higher than 60%, (ii) L is lower than or equal to 60, or (iii) the ratio of c to L is higher than 60% and L is lower than or equal to 60.

2. Paper according to claim 1, wherein it comprises a coloring agent in the stock.

3. Paper according to claim 2, wherein it contains a liquid coloring agent from 5 to 10% by weight of the weight of the finished paper.

4. Paper according to claim 2, wherein the coloring agent is a coloring agent which is fixed directly to the cellulose.

5. Paper according to claim 1, wherein the ratio of c to L is higher than 70%.

6. Paper according to claim 5, wherein L is lower than or equal to 60.

7. Paper according to claim 5, wherein L is lower than or equal to 50.

8. Paper according to claim 1, wherein L is lower than or equal to 60.

9. Paper according to claim 1, wherein L is lower than or equal to 50.

10. Paper according to claim 1, wherein the Bekk smoothness of the chemical composition is below 30 seconds.

11. Process for making a paper which is transparent or translucent or both transparent and translucent, in that it contains fibers with a high beating value or it is made of transparentized opaque paper by a chemical composition with Bekk smoothness below 2,000 seconds, in which 100% of the cellulose is in the form of fibers or fibrils or both fibers and fibrils, and which has an intense or dark color defined by chroma c and brightness L in the following manner:

(i) the ratio of c to L is higher than 60%, (ii) L is lower an or equal to 60, or (iii) the ratio of c to L is higher than 60% and L is lower than or equal to 60, wherein an aqueous suspension of paper pulp is beaten to a Schöpper degree higher than 50, a coloring agent is fed into the headbox at the same time as the aqueous suspension of fibers, the aqueous suspension of fibers and coloring agent is deposited on the wire of a Fourdrinier paper machine, the water is removed by gravity, and the sheet thus obtained is dried between roller dryers.

12. Process according to claim 11, wherein the aqueous suspension of fibers and coloring agent just before the headbox is kept at a temperature between 80° C. and 100° C.

13. Process according to claim 12, wherein the aqueous suspension of paper pulp is beaten to a Schöpper degree higher than 80.

14. Process according to claim 11, wherein the amount of liquid coloring agent is introduced in an amount from 5% to 10% of the weight of the finished paper.

15. Process according to claim 14, wherein the aqueous suspension of paper pulp is beaten to a Schöpper degree higher than 80.

16. Process according to claim 11, wherein a coloring agent in an aqueous medium is also deposited in the size press.

17. Process according to claim 16, wherein the aqueous suspension of paper pulp is beaten to a Schöpper degree higher than 80.

18. Process according to claim 11, wherein the aqueous suspension of paper pulp is beaten to a Schöpper degree higher than 80.

19. Process for making a paper which is transparent or translucent or both transparent and translucent, in that it contains fibers with a high beating value or it is made of transparentized opaque paper by a chemical composition with Bekk smoothness below 2,000 seconds, in which 100% of the cellulose is in the form of fibers or fibrils or both fibers and fibrils, and which has an intense or dark color defined by chroma c and brightness L in the following manner:

(i) the ratio of c to L is higher than 60%, (ii) L is lower than or equal to 60, or (iii) the ratio of c to L is higher than 60% and L is lower than or equal to 60, wherein an aqueous suspension of fibers and a water soluble coloring agent is prepared and deposited on the wire of a Fourdrinier paper machine, the water is removed by gravity, the sheet is dried between roller dryers, the sheet thus dried is coated with a transparentizing chemical compound and the sheet is dried.

20. Paper which is transparent or translucent or both transparent and translucent, in that it contains fibers with a high beating value, in which 100% of the cellulose is in the form of fibers or fibrils or both fibers and fibrils, said paper having a Bekk smoothness below 2,000 seconds, and having an intense or dark color defined by chroma c and brightness L in the following manner:

(i) the ratio of c to L is higher than 60%, (ii) L is lower than or equal to 60, or (iii) the ratio of c to L is higher than 60% and L is lower than or equal to 60.

21. Paper according to claim 20, which is a tracing paper.

* * * * *